US005978982A

United States Patent [19]

Leeuwerik

[11] Patent Number: 5,978,982

[45] Date of Patent: Nov. 9, 1999

[54] WHIRLPOOL INJECTOR AND WHIRLPOOL SYSTEM

[75] Inventor: Berend B. Leeuwerik, Oude Pekela, Netherlands

[73] Assignee: Sanilux B.V., Stadskanaal, Netherlands

[21] Appl. No.: 09/021,127

[22] Filed: Feb. 10, 1998

[30] Foreign Application Priority Data

Feb. 10, 1997 [NL] Netherlands ..... 1005235

[51] Int. Cl.[6] ..... A61H 33/02

[52] U.S. Cl. ..... 4/541.6; 239/290; 239/423

[58] Field of Search ..... 4/541.1–541.6, 4/492; 239/290, 423, 424, 589

[56] References Cited

U.S. PATENT DOCUMENTS

| | | | |
|---|---|---|---|
| 3,050,262 | 8/1962 | Curtis | 239/424 |
| 4,628,908 | 12/1986 | Dupont | 4/541.5 |
| 5,012,535 | 5/1991 | Klotzbach | 4/541.6 |
| 5,220,695 | 6/1993 | Henkin et al. | 4/541.6 |
| 5,226,601 | 7/1993 | Hinojosa, Jr. et al. | 239/423 |
| 5,279,003 | 1/1994 | Gape et al. | 4/541.6 |
| 5,345,996 | 9/1994 | Druien | 4/541.5 |
| 5,381,563 | 1/1995 | Isabelle et al. | 4/541.5 |

FOREIGN PATENT DOCUMENTS

| | | | |
|---|---|---|---|
| 0 354 596 A2 | 2/1990 | European Pat. Off. . | |
| 0 503 239 A1 | 9/1992 | European Pat. Off. . | |
| 0 613 673 A1 | 9/1994 | European Pat. Off. . | |
| 3903477 | 8/1990 | Germany | 4/541.6 |
| 195 06 003 A1 | 8/1996 | Germany . | |

*Primary Examiner*—Charles R. Eloshway

*Attorney, Agent, or Firm*—Burns, Doane, Swecker & Mathis, L.L.P.

[57] ABSTRACT

A whirlpool injector with an air supply channel (4, 104) and a water supply channel (5, 105), a mixing space (6, 106) in which terminate the air supply channel (4, 104) and the water supply channel (5, 105), and a water/air outflow passage (7, 107) downstream of the mixing space (6, 106). A further air supply channel (10, 110) runs separately from the water supply channel (5, 105) and the first-mentioned air supply channel (4, 104), and opens outwardly via a separate air outflow passage (11, 111). When the water/air outflow passage is closed off, no water is forced into the further air supply channel. The risk of contact between water and live parts of a fan or the like in or upstream of the further air supply channel is limited considerably. The additional air outflow passage can be specifically designed for injecting air alone. The invention can also be embodied in a whirlpool system.

12 Claims, 2 Drawing Sheets

Fig. 3
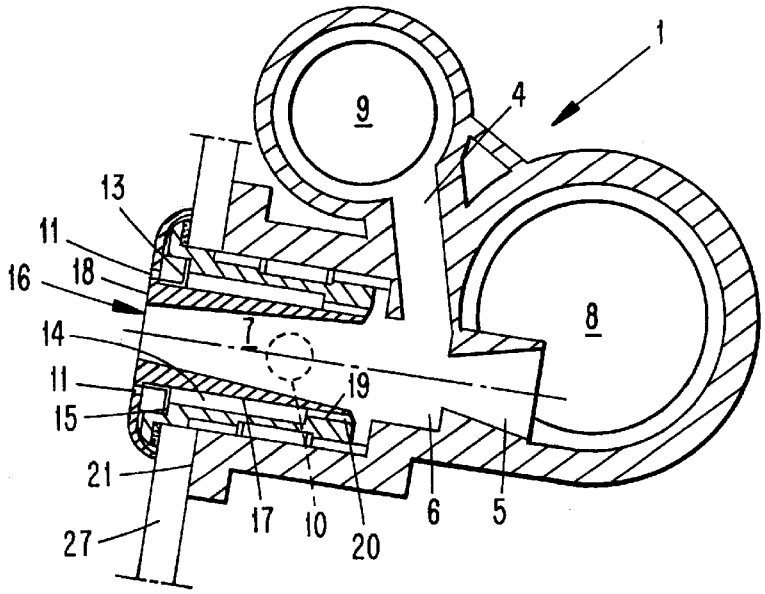
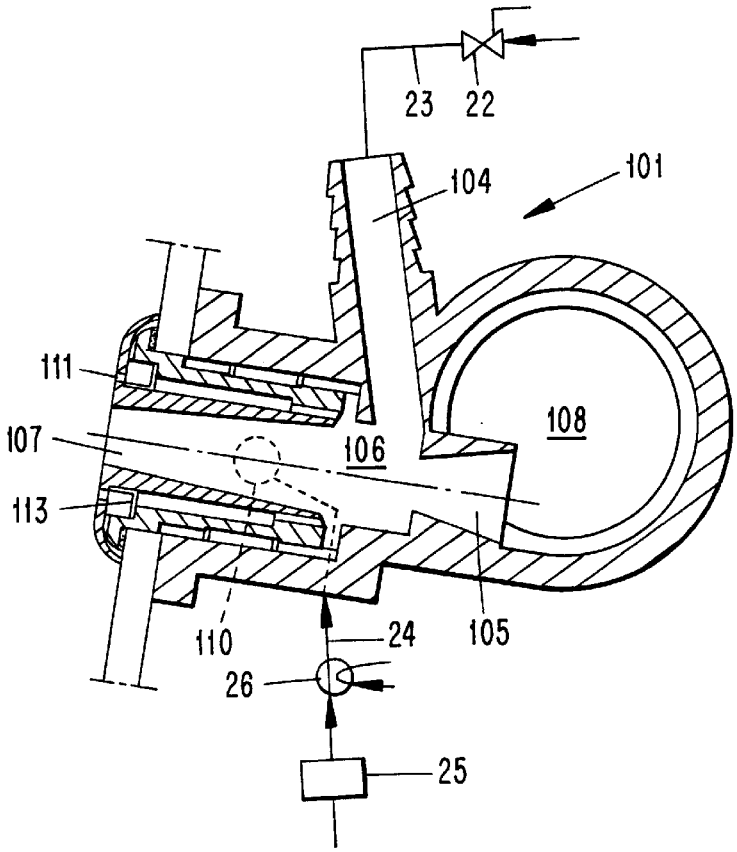
Fig. 4

WHIRLPOOL INJECTOR AND WHIRLPOOL SYSTEM

This invention relates to a whirlpool injector according to the preamble of claim 1, and to a whirlpool system.

Whirlpool systems with injectors as indicated above are known from practice and are suitable for forcibly injecting jets of water, or of water mixed with air, into bath water in a bath.

To that end, such a whirlpool system includes a powerful pump which supplies water via the water supply channel. If the air supply channel is closed, water alone is injected into the bath water. If the air supply channel is open, air is mixed in the mixing space with the water supplied, and injected into the bath water as an effervescent fluid. The admixture of air to the water supplied generally occurs directly downstream of a venturi in the water supply channel. If more air, or air alone, is to be supplied, the air is supplied under pressure by a fan.

In such whirlpool systems a problem occurs in that water supplied under overpressure is forcefully pushed into the air supply channel if the water/air outflow passage is closed off while the system is in operation. This can be caused, for instance, by a bathing person blocking the water/air outflow passage with his body. The water may then reach the fan in, or upstream of, the air supply channel. Since the fan is generally equipped with an electric motor, this involves a substantial risk of the bathing person being exposed to an electrical shock via the water in the bath and the water in, and possibly upstream of, the air supply channel.

This problem occurs in particular if the water pressure is successively guided exclusively to individual ones of the injectors according to a cyclic pattern, because then it is impossible for overpressure to equalize towards other, unblocked water/air outflow passages. True, the air supply channels or pipes upstream thereof are generally fitted with one-way valves, but these may be leaky or fail to function altogether due to, for instance, wear, aging and/or fouling. Also in the event of intermittent countercurrent in the air supply channel, such valves may leak water under unfavorable circumstances.

A further drawback of such known whirlpool systems is that if air alone is being injected into the bath water, no pleasant effect is obtained, but only a fairly crude track of bubbles is generated.

The object of the invention is to provide a solution to the above problem and to obviate the above drawbacks without entailing substantial additional costs.

This object is achieved, according to the present invention, by designing a whirlpool injector of the above-indicated type in accordance with the characterizing portion of claim 1.

Owing to the provision of at least one further air supply channel, which runs separately from the water supply channel and the first-mentioned air supply channel, and owing to the feature that the further air supply channel terminates via at least one separate air outflow passage for injecting air into the bath water, air supplied under pressure can be injected independently of the water supply, via a separate channel and a separate outlet or several separate outlets.

Accordingly, no fan or the like is needed upstream of the mixing space for injecting additional air, or air alone, into the bath. When a fan or the like in an air supply upstream of the mixing space is absent, so is the risk that as a result of the water/air outflow passage being blocked, water which has penetrated upstream of the mixing space via the air supply channel can come into contact with live parts of that fan or the like.

Because the further air supply channel has its own outflow passage and further does not communicate with the water supply channel, closing off the water/air outflow passage during the supply of water under pressure does not lead to water being forced towards the fan or the like in the further air supply channel. Electrical contact between live parts of a fan or of other electrical components in the air supply structure and water forced into the air supply structure as a result of the overpressure is therefore, in principle, precluded.

A further advantage of the whirlpool injector according to the invention is that the outflow passage or passages of the further air supply channel serve(s) solely for injecting air. Accordingly, these can be specifically designed for injecting air. Especially when injecting air alone, a more pleasant effect can then be obtained than when the above-discussed known whirlpool injectors are used. Even so, via the outflow passages of the further air supply channel it is yet possible to inject additional air for enriching with air a water/air mixture injected via the water/air outflow passage. The simultaneously injected water carries the additional air along as a fairly strongly concentrated jet, far into the bath water.

The invention can further be embodied in a whirlpool system according to claim 10. Because the blowing means does not communicate with the water supply channel upstream of the water/air outflow passage, no water will be forced towards the blowing means upon closing off the water/air outflow passage while water is being supplied under pressure. The risk of a conductive connection being formed between live electrical conductors of the blowing means and water in the bath is thus reduced considerably. Further, in a whirlpool system according to the invention the air outflow passages also serve solely for injecting air into the bath water, while no separate injectors for injecting air need to be mounted and the injected air can still serve as additional air in support of a water/air mixture being simultaneously injected via the water/air outflow passage.

Particular embodiments of the present invention are described in the dependent claims.

Hereinafter the invention is further illustrated and explained on the basis of two exemplary embodiments, with reference to the drawings, wherein:

FIG. 3 shows a view similar to FIG. 1, with an identical whirlpool injector now mounted in a bath wall; and FIG. 4 shows a view similar to FIG. 3, of a whirlpool injector according to a second exemplary embodiment, with a schematic representation of a few components of a whirlpool system of which the whirlpool injector shown forms a part.

The invention will first be illustrated with reference to FIGS. 1 and 2. Then follows a discussion of the particular features shown in FIGS. 3 and 4.

Figure 2:
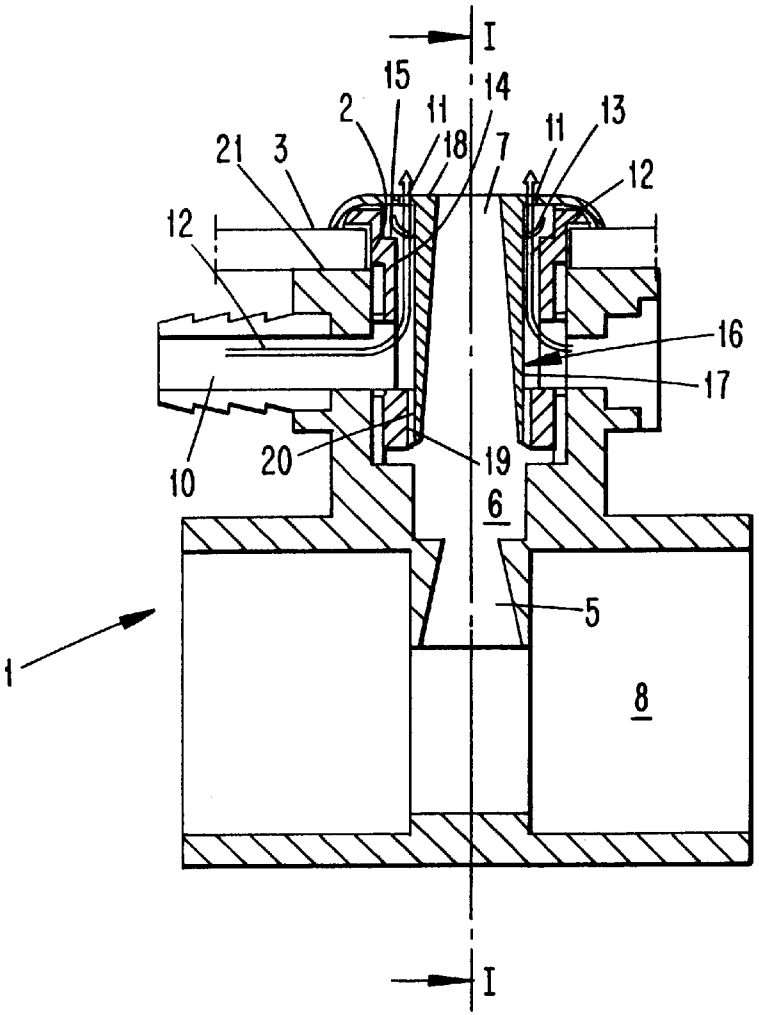
FIG. 2 shows the whirlpool injector according to FIG. 1 in a sectional view taken along line II—II in FIG. 1.
Figure 1:
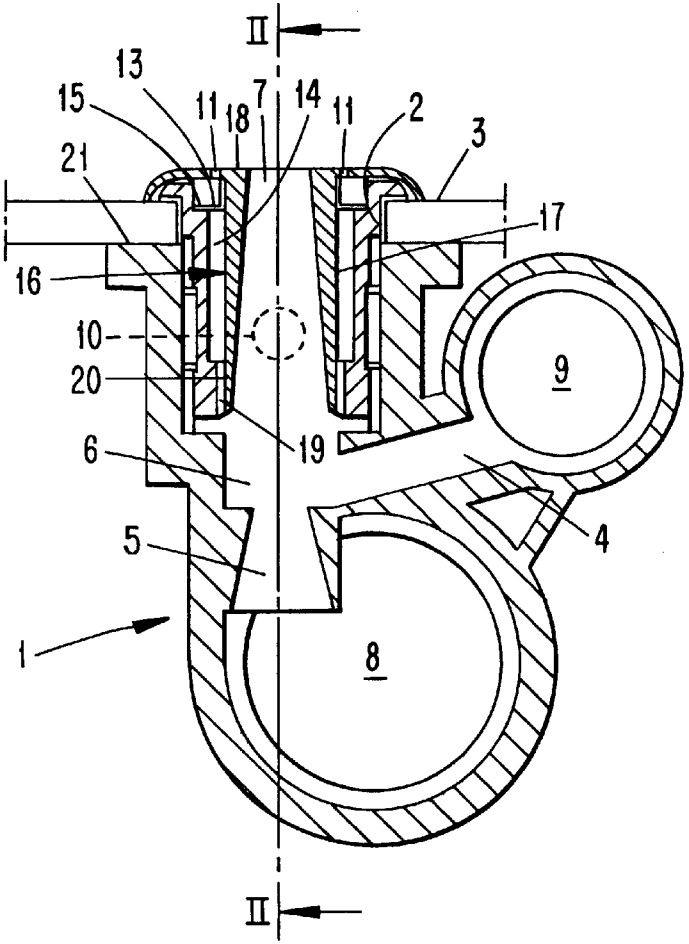
FIG. 1 shows a whirlpool injector according to a first exemplary embodiment, mounted in a bath bottom, in a sectional view taken on the line I—I in FIG. 2.

FIGS. 1 and 2 show a whirlpool injector 1 which is built into a hole 2 in a bottom 3 of a bathtub. Of the bathtub, only a bottom portion immediately adjacent to the whirlpool injector 1 is shown. The whirlpool injector 1 includes an air supply channel 4, a water supply channel 5, a mixing space 6 in which terminate the air supply channel 4 and the water supply channel 5, and a water/air outflow passage 7 downstream of the mixing space 6. Water and air can be injected via the water/air outflow passage 7 into bath water in the bath 3. The water supply channel 5 is connected to a section of a water distribution channel 8 integrated into the injector 1, and the air supply channel 4 is connected to an air distribution channel 9. The mixing space 6 is located directly downstream of the water supply channel 5 designed in the form of a venturi, so that during the supply of water, air is entrained from the air supply channel 4, without this air needing to be supplied with overpressure. In the mixing space 6 and the water/air outflow passage 7, the entrained air is mixed with the water supplied. By simply shutting off the air supply channel 4, or a supply channel upstream thereof, water alone can be injected.

The whirlpool injector 1 includes a further air supply channel 10, which runs separately from the water supply channel 5 and the first-mentioned air supply channel 4. The further air supply channel 10 terminates in air outflow passages 11 running separately from the water/air outflow passage 7. In FIG. 2 arrows 12 indicate how the air can be injected into the bath water via the further air supply channel 10 and the air outflow passages 11. The upstream end of the further air supply channel 10 is formed by a tubular duct with circumferential retention edges to which an air supply hose can be connected.

Via the further air supply channel 10, air supplied under pressure can be injected independently of the water supply, via a separate channel and separate outlets.

Accordingly, no fan or the like is needed in the air supply channel 4, or a pipe upstream thereof, to inject additional air, or air alone, into the bath.

Because the further air supply channel 10 has an outflow passage 11 of its own and further does not communicate with the water supply channel 5, closing off the water/air outflow passage 7 while water is being supplied under pressure does not lead to water being forced into the further air supply channel 10.

The risk that as a result of the water/air outflow passage 7 being blocked, water which has penetrated upstream of the mixing space 6 via the air supply channel 4 comes into contact with live parts of a fan or the like can thus be simply limited without sacrificing the possibility of supplying air under pressure. Because in principle no water will be forced into the further air supply channel 10, it is safe to accommodate in that channel, or upstream thereof, an electrical heating element for heating air to be injected.

The outflow passages 11 of the further air supply channel 10 serve exclusively for injecting air. Accordingly, they are specifically designed for injecting air. Especially when injecting air alone, a more pleasant effect can thereby be obtained than when injecting air via a passage at the same time intended for injecting water and mixtures of water and air. Because the outflow passages 11 of the further air supply channel 10 are located close to the water/air outflow passage 7, it is still possible to inject additional air to enrich an injected water/air mixture.

The air outflow passages 11 form a ring-shaped system of successive passages, which in front view is located coaxially with respect to the water/air outflow passage 7. By virtue of this coaxial positioning of the system of air-outflow passages 11 and the water/air outflow passage 7, when simultaneously injecting water, or a mixture of water and air, via the water/air outflow passage 7, and air via the air outflow passages 11, the injected water carries the additional air particularly far into the bath water.

Owing to the provision of several air outflow passages 11 each having a diameter smaller than the diameter of the water/air outflow passage 7, the air outflow passages 11 are highly suited for injecting a finely divided jet of bubbles into bath water. Small air bubbles surface slower than do large ones. The effect of the injected air is thereby comparatively prolonged.

In order to further limit the risk of water penetrating into the further air supply channel 10, and to control fouling and germ growth in the further air supply channel 10, the whirlpool injector includes a one-way valve 13 in the further air supply channel 10.

The further air supply channel 10 has a portion 14 ring-shaped in cross section, and a circumferential ring surface 15 facing in downstream direction. The one-way valve 13 is formed by a flange of a circumferential ring-shaped seal which is pivotally suspended along a wall opposite the ring surface 15. Thus a one-way valve 13 is obtained which is simple in construction and can be positioned far downstream in the air supply channel 10, so that the further air supply channel 10 is closed off at a point close to its downstream end to resist water penetrating in upstream direction.

The one-way valve 13 is represented in closed condition in FIGS. 1 and 3 and in open condition in FIG. 2.

In the downstream portion of the whirlpool injector the separation between the water/air outflow passage 7 and the further air supply channel 10 is designed as a removable bush-shaped element 16 with a circumferential wall 17 which constitutes an outer boundary of the water/air outflow passage 7 and an inner boundary of the ring-shaped portion 14 of the further air supply channel 10. The bush-shaped element 16 has an outwardly facing surface 18 through which penetrate the water/air outflow passage 7 and the air outflow passages 11.

By removing the bush-shaped element 16, the walls of the water/air outflow passage 7 and of a downstream portion of the further air supply channel 10 are rendered readily accessible for cleaning. Further, the ring-shaped one-way valve 13, which is arranged around the wall 17 of the bush-shaped element 16, can be simply inspected and cleaned. Also, replacement of the one-way valve 13 is thus simply enabled.

The bush-shaped element 16 is unscrewable, and in assembled condition is firmly retained in the whirlpool injector 1 by cooperating screw thread portions 19, 20.

The whirlpool injector 1 further comprises a mounting surface 21 which in a front view extends around the water/air outflow passage 7 and which defines a surface against which the injector 1 can be mounted via the mounting surface 21 thereof. The air supply channel 4 connecting to the mixing space 6 connects to the mixing space 6 in a direction which, towards the mixing space 6, extends away from the surface defined by the mounting surface 21. As a result, the air supply channel 4 is self-draining, both when the whirlpool injector 1 is mounted in the bottom 3 of a bath (as shown in FIG. 1) and when it is mounted in the wall 27 of a bath (as shown in FIG. 3). Thus, identical whirlpool injectors 1 can be used for mounting in the bottom and in the wall. This is favorable for achieving a greater size of series and for simplifying logistics during manufacture and distribution.

The self-draining properties of the air supply channel 4 are of particular importance in a whirlpool injector 1 with an additional, separate air supply channel 10 for injecting additional air under pressure, as described hereinbefore, because in such an injector 1, upstream of the air supply channel 4, preferably no fan or the like is utilized and thus no facilities are present for blowing dry the air supply channel 10 connecting to the mixing chamber 6. Even so, the described orientation of the air supply channel 4, with the air supply channel 4 extending, in the direction of the mixing space 6, away from the surface against which the injector 1 can be mounted, can also be used with advantage in injectors without an additional, separately terminating air supply channel. In that case, too, the advantage gained is that less water remains behind in the air supply channel connecting to the mixing space and that, accordingly, the air supply channel can be dried faster.

In FIG. 4 a whirlpool injector 101 according to a slightly different embodiment is shown. In this whirlpool injector 101 the air supply channel 104 which terminates in the mixing space 106 does not connect to a section of a distribution channel integrated into the whirlpool injector 101, but the upstream portion of the air supply channel 104 is designed as a tubular duct with circumferential retention edges, to which an air supply hose can be directly connected.

The water supply channel 105, the water/air outflow passage 107, the section of the water distribution channel 108 integrated into the injector 101, the further air supply channel 110 and the air outflow passage 111 are basically designed as with the injector 1 discussed hereinabove.

Additionally, FIG. 4 schematically shows further components of a whirlpool system. One of those components is a manually operable control valve 22 in an air supply pipe 23 upstream of the air supply channel 104. By means of this valve 22, which is preferably operable by means of a knob adjacent the bathtub, the amount of air drawn in by the water can be regulated. Valves such as the valve 22 may also be automatically operated in a relatively simple manner. For controlling the opening and closure of such valves, for instance a control unit can be used which intermittently operates valves associated with different injectors according to predetermined cycles.

The further air supply channel 110 communicates with a fan 25, included upstream of channel 110 in a further air supply pipe 24, for supplying air under overpressure via the further air supply pipe 24 and the further air supply channel 110. The further air supply pipe 24 further includes a heating element 26 for heating passing air.

Because the blowing means 25 and the heating element 26 do not upstream of the water/air outflow passage 107 communicate with the water supply channel 105, upon the water/air outflow passage being blocked while water is being supplied under pressure, no water will be forced towards the blowing means 25 or the heating element 26. The risk of a conductive connection being formed between live electrical conductors and water in the bath has thus been reduced considerably.

The presence of the heating element 26 further makes it possible to speedily blow dry the further air supply pipe 24 and the further air supply channel 110 after use of the whirlpool system, so that even if some drops have leaked past the one-way valve 113, fouling and germ growth are still prevented. At the same time, by blowing dry the air supply channel 110, calcium precipitation in the area of the one-way valve 113, and hence leakage, is prevented. Preferably, the blow-dry operation is carried out with air of a temperature of 67° C. or higher, so that germs, if any, are killed.

What is claimed is:

1. A whirlpool injector comprising an air supply channel and a water supply channel, a mixing space in which terminate said air supply channel and said water supply channel, and a water/air outflow passage downstream of said mixing space for injecting water and air into bath water in a bath, said whirlpool injector further including at least one further air supply channel, which runs separately from said water supply channel and the first-mentioned air supply channel, and at least one separate air outflow passage located exteriorly of said water/air outflow passage via which said further air supply channel terminates for injecting air directly into the bath water, wherein air fed via the first air supply channel is mixed with water at a location different from that where air supplied via the further air supply channel is mixed with water.

2. The whirlpool injector according to claim 1, wherein said at least one air outflow passage is located coaxially with respect to said water/air outflow passage.

3. The whirlpool injector according to claim 1, wherein said at least one air outflow passage is formed by at least two outflow passages each having a diameter smaller than the diameter of the water/air outflow passage.

4. The whirlpool injector according to claim 1, wherein said mixing space connects to a venturi in the water supply channel.

5. The whirlpool injector according to claim 1, further comprising a one-way valve in said at least one further air supply channel.

6. The whirlpool injector according to claim 5, wherein the at least one further air supply channel is at least partly ring-shaped in cross section and has a circumferential ring surface facing downstream, and wherein the one-way valve is designed as a flange of a circumferential ring-shaped seal which is pivotally suspended along a wall opposite said ring surface.

7. The whirlpool injector according to claim 1, further comprising a removable bush-shaped element with a circumferential wall which constitutes an outer boundary of said water/air outflow passage and an inner boundary of said at least one further air supply channel, and which element has an outwardly facing surface through which penetrate said water/air outflow passage and said at least one air outflow passage.

8. The whirlpool injector according to claim 7, wherein said bush-shaped element is unscrewable.

9. The whirlpool injector according to claim 1, further comprising a mounting surface which in a front view extends adjacent the water/air outflow passage and which defines a surface against which the injector is mounted via said mounting surface, while the air supply channel connecting to the mixing space connects to said mixing space at an angle in a direction away from said surface.

10. A whirlpool system with the whirlpool injector according to claim 1, wherein said at least one further air supply channel communicates with a blowing means located upstream thereof, for supplying air under overpressure via said at least one further air supply channel.

11. The whirlpool system according to claim 10, wherein said at least one further air supply channel communicates with a heating element located upstream thereof, for heating passing air.

12. The whirlpool system according to claim 10, wherein the air supply channel connecting to the mixing space communicates with an adjustable valve, located upstream of said air supply channel, for adjusting the air supply.

* * * * *